United States Patent [19]

Samuelson

[11] 4,150,955

[45] Apr. 24, 1979

[54] DEFORMABLE NON-CELLULAR POLYURETHANE POLISHING WHEEL

[75] Inventor: Ivar J. Samuelson, Fairview Park, Ohio

[73] Assignee: The Manufacturers Brush Company, Cleveland, Ohio

[21] Appl. No.: 834,420

[22] Filed: Sep. 19, 1977

Related U.S. Application Data

[60] Division of Ser. No. 615,539, Sep. 22, 1975, Pat. No. 4,048,765, which is a continuation-in-part of Ser. No. 465,843, May 1, 1974, abandoned.

[51] Int. Cl.[2] ..... B24B 1/00; B24B 37/02

[52] U.S. Cl. ..... 51/298; 51/295

[58] Field of Search ..... 51/295, 298, 296

[56] References Cited

U.S. PATENT DOCUMENTS

| | | | |
|---|---|---|---|
| 3,252,775 | 5/1966 | Guilbert | 51/295 |
| 3,529,945 | 9/1970 | Charvat | 51/296 |
| 3,850,589 | 11/1974 | Charvat | 51/296 |
| 3,864,101 | 2/1975 | Charvat | 51/298 |
| 3,918,220 | 11/1975 | Jury et al. | 51/296 |

*Primary Examiner*—Donald J. Arnold

*Attorney, Agent, or Firm*—Bosworth, Sessions & McCoy

[57] ABSTRACT

A non-cellular polyurethane polishing and finishing wheel is disclosed having a molded annular matrix reinforced at the inner circumference by a circumferential reinforcing means. The radially outer portion of the matrix is free to deform during use and is formed of a flexible elastomeric polyurethane having a no-grain Shore A durometer hardness from about 30 to about 55 and a high tensile strength. Proper distribution of the abrasive refractory grains is achieved by employing a polyurethane prepolymer having a high viscosity of 2000 to 6000 centipoises at the curing temperature, and the curing agent is selected to provide the required flexibility and tensile strength and also to effect curing rapidly so that the abrasive grains remain in position during curing. The polyurethane composition preferably contains up to 100 parts of finely divided abrasive material, 3 to 20 parts of mica, and up to 10 parts of molybdenum disulfide per 100 parts by weight of the polyurethane prepolymer. The polyurethane polishing and finishing wheels of the present invention have a useful life at least several times that of the flexible wheels previously used and make it commercially practical for the first time to employ such wheels on machines such as O.D. grinders, centerless grinding machines and the like.

6 Claims, 14 Drawing Figures

DEFORMABLE NON-CELLULAR POLYURETHANE POLISHING WHEEL

CROSS REFERENCE TO RELATED APPLICATIONS

This application is a division of my copending U.S. patent application Ser. No. 615,539, filed Sept. 22, 1975, now U.S. Pat. No. 4,048,765 which is a continuation-in-part of my earlier-filed application Ser. No. 465,843, filed May 1, 1974, now abandoned.

BACKGROUND OF THE INVENTION

The present invention relates to the use of deformable polyurethane wheels in polishing, finishing and deburring operations and, more particularly, to an elastomeric polyurethane polishing and finishing wheel of high tensile strength which functions in an improved manner and has an exceptionally long useful life.

At the present time, setup wheels are widely used to carry out polishing and finishing operations on metal parts despite a number of recognized drawbacks. Such wheels are built up of a plurality of pieces of cloth which are coated with abrasive material. The useful life between setups (renewal of the abrasive coating) tends to be relatively short and costs are high, but the setup wheels are used nevertheless because of lack of superior substitutes.

To some extent the setup wheels have been replaced by flexible spirally-wound abrasive wheels formed by wrapping abrasive coated woven nylon material or the like, such as the "Tycro" finishing and deburring wheels made by Minnesota Mining and Manufacturing Company, but such spirally-wound abrasive wheels wear out very rapidly and so fast that they are impractical for use in various machines because of the time required for wheel replacement.

Abrasive belts and other abrading equipment have also been used for polishing and finishing operations but they are generally less popular than the setup wheels and spirally-wound wheels mentioned above.

Rigid polyurethane grinding wheels have been disclosed, for example, in U.S. Pat. No. 3,377,411, and various wire brushes have been made with a reinforcement of polyurethane or other thermosetting synthetic resin material, as disclosed, for example, in U.S. Pat. Nos. 3,129,269; 3,147,503 and 3,142,081. An abrasive wheel is disclosed in U.S. Pat. No. 3,252,775 made of a soft low-density polyurethane foam, but this type of wheel has poor strength and poor wearing properties and has not been successful commercially. During the last decade the industry has employed different types of wheels for polishing operations such as cork wheels or spirally-wound wheels. It was not recognized, prior to the present invention, that polishing and surface refining operations could be carried out more effectively using abrasive wheels made of a flexible solid polyurethane elastomer.

SUMMARY OF THE INVENTION

The present invention involves the discovery of a unique, highly flexible, deformable polyurethane polishing or finishing wheel with a high density and suitable reinforcement to resist expansion under centrifugal force, which wheel lasts at least 3 to 5 times as long as the spirally-wound finishing wheels for most polishing, finishing and deburring operations and frequently much longer.

The polyurethane composition used to form the wheel preferably contains 3 to 10 parts of mica, ½ to 10 parts of molybdenum disulfide, and 20 to 90 parts or more of abrasive grains per 100 parts by weight of the polyurethane prepolymer. The amount of filler is limited and the curing agent carefully selected so that the resulting solid elastomer has the desired high quality and strength. The molybdenum disulfide is needed to increase the heat distortion point of the polyurethane, decrease the friction and prevent clogging and buildup on the surface of the wheel.

The polyurethane is cast around the reinforcing members which have a smaller diameter than the wheel so as to prevent expansion of the polyurethane and still provide an outer circumferential area capable of doing the polishing and finishing. The polyurethane composition should cure within 2 or 3 minutes or less and must have a viscosity sufficient to prevent settling of the abrasive grains during the molding and curing operation. After curing, the polyurethane is relatively soft but still retains high tensile strength and other physical properties.

An object of the present invention is to provide a polishing and finishing wheel which has a life several times that of previously known wheels and can be operated at lower cost.

Another object of the invention is to provide a polishing and finishing wheel well suited for use in O.D. grinders and centerless machines for finishing, lapping and honing operations.

A still further object of the invention is to reduce the number of finishing operations needed for refining the surface of ground metal parts.

Another object of the invention is to provide a superior deburring wheel which conforms more closely to the shape of the workpiece while avoiding damage thereto.

These and other objects, uses and advantages of the present invention will become apparent to those skilled in the art from the following drawings and description which illustrate some embodiments of the invention.

DESCRIPTION OF THE PREFERRED EMBODIMENT

Figure 1:
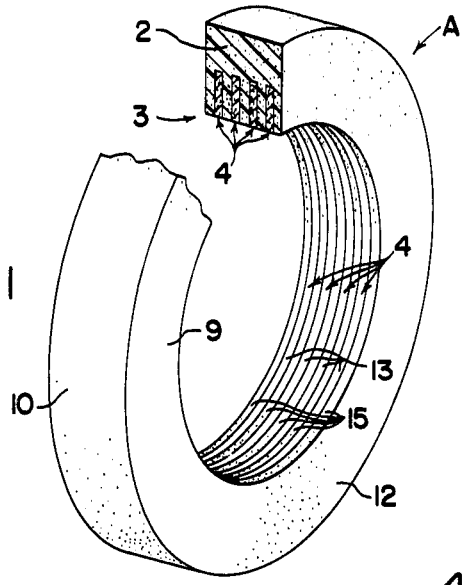
FIG. 1 is a schematic view of the polishing and finishing wheel of the present invention on a reduced scale, parts being broken away and shown in section.

Referring more particularly to the drawings which are drawn to scale in FIGS. 3, 4, 8 and 9 and in which like parts are identified by the same numerals throughout the several views, FIG. 1 shows a typical polyurethane polishing and finishing wheel A made according to the present invention consisting of an annular deformable elastic matrix 2 of rectangular cross section having circumferential reinforcing means 3 in the form of a series of flat annular reinforcing members or washers 4 of substantially uniform thickness. The matrix 2 is formed by molding a curable high viscosity polyurethane composition as described in more detail hereinafter having evenly distributed therein a minor portion by volume of finely divided abrasive grains.

Figure 2:
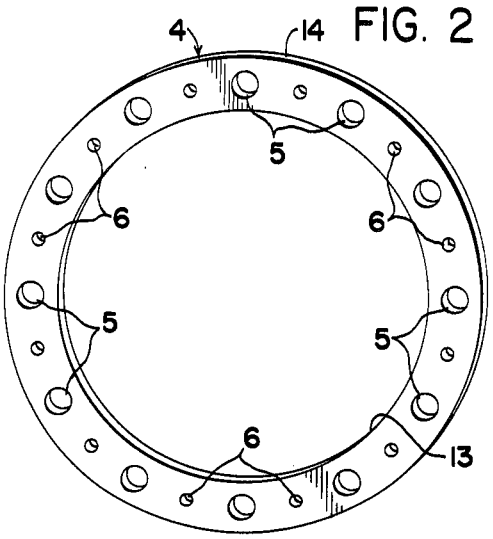
FIG. 2 is a perspective view on a reduced scale of a reinforcing member used in the wheel of FIG. 1.
Figure 3:
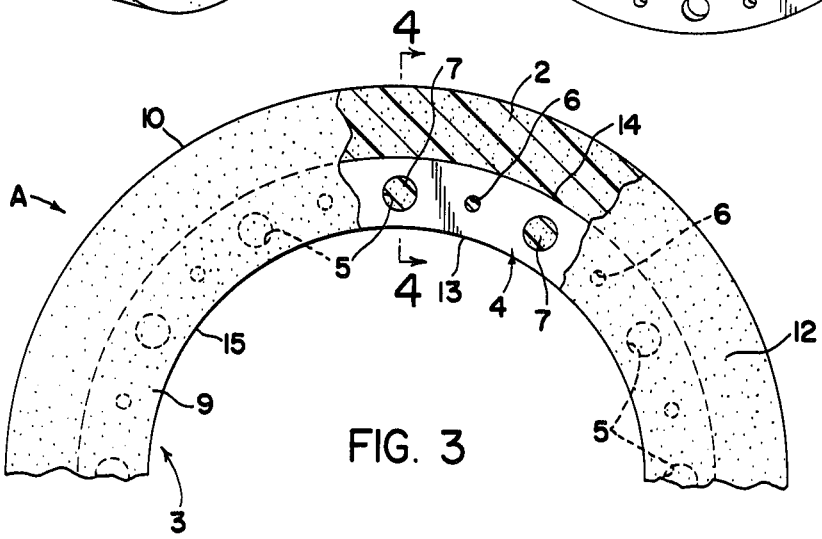
FIG. 3 is a fragmentary side elevational view of the polishing and finishing wheel on a reduced scale with parts broken away and shown in section.
Figure 4:
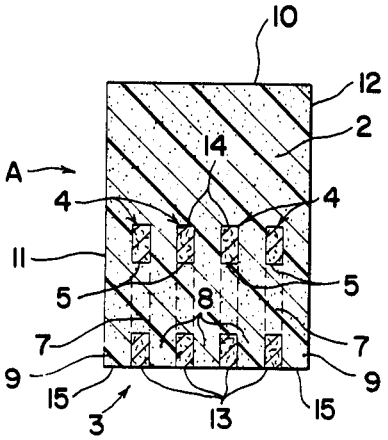
FIG. 4 is a sectional view taken on the line 4—4 of FIG. 3 and on a larger scale.
Figure 5:
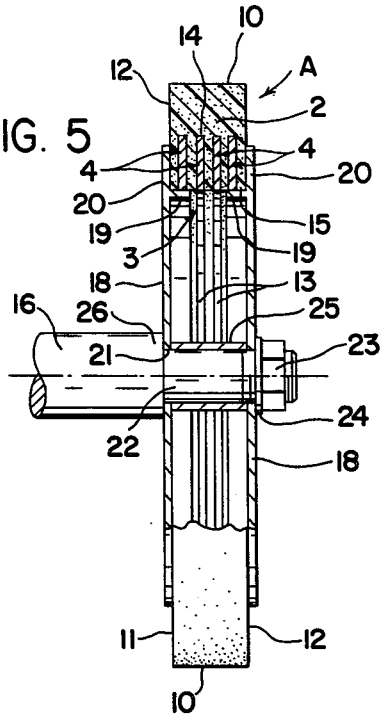
FIG. 5 is an elevational view on a reduced scale with parts broken away and shown in section showing the polishing and finishing wheel mounted on a rotatable shaft.

Each reinforcing member 4 has a large number (i.e., 8 to 16) of regularly spaced circular holes 5 therein and may also have small locating holes 6 as shown in FIG. 2. The holes 5 may, for example, have a diameter of 0.3 to 1.0 inch depending on the size of member 4. A series of members 4 are placed in the casting mold and held in regularly spaced parallel positions during filling of the mold and during curing so that they are embedded in the matrix 2 as shown in FIGS. 3 and 4. The matrix has portions 7 which fill the holes 5, portions 8 which occupy the spaces between the adjacent parallel members 4, and outer side portions 9 which occupy the space between the outermost member 4 and the side face of the wheel. Thus, the circumferential reinforcing means 3 is embedded in and permanently held in place in the matrix 2.

While the shape of the polishing wheel A may be varied in accordance with the intended use, the wheel is usually molded to a rectangular cross section as in FIG. 4 to provide a cylindrical work-engaging surface 10 of uniform axial width and flat parallel side faces 11 and 12 of uniform radial width. The interior and exterior cylindrical surfaces 13 and 14 of the members 4 are preferably coaxial with the surface 10, and the surfaces 13 are preferably in axial alignment with the interior cylindrical surfaces 15 of the matrix 2.

A plurality of reinforcing members 4 are needed to secure the radially inner portion of the deformable elastic matrix and to resist stretching of the same under centrifugal force. Preferably, three to five members 4 are provided per inch of axial width of the matrix 2, and ten or more of such members may be used where the axial width of surface 10 is three inches.

In each of the embodiments shown in the drawings, the reinforcing members 4 or 34 are preferably formed of a relatively inexpensive fibrous material, such as a cardboard fiber, paper fiber or the like, but they can also be formed of other materials such as plastic, cloth, fiberglass or steel. When formed of a fiber-board or pressed fiber, the thickness is preferably about 0.1 to about 0.2 inch.

The polyurethane polishing and finishing wheels of the present invention usually have a cylindrical work-engaging surface 10 with an outside diameter from six to thirty-six inches and an axial width from one-half inch to six inches but they can be smaller or larger than this.

The polishing wheel of this invention may be rotatably mounted on a shaft in any suitable manner as is well understood in the art. The matrix 2 may be mounted on a hub or may be clamped between a pair of mounting discs or the like. As herein shown, it is mounted on a pair of flat circular rigid metal mounting discs 18, each having a cylindrical flange 19 fitting inside the internal cylindrical surface 15 of the wheel, an outer marginal portion 20 engaging the side face 11 or 12 of the wheel, and a central circular hole 21.

The discs 18 are mounted on a motor-driven shaft 16 for rotation in unison with the shaft, said shaft having a reduced cylindrical end portion 22 which is of a size to fit the holes 21 and which is threaded at the outer end to receive a nut 23 and a washer 24. As shown for purposes of illustration, a spacer sleeve 25 is mounted on portion 22 between the two discs 18 and the assembly is clamped against the annular shoulder 26 of the shaft by tightening the nut 23, but it will be understood that many other mounting arrangements may be used. The assembly is preferably designed so that the matrix 2 is tightly clamped between the mounting discs and so that the wheel will be driven in unison with the shaft 16. A positive driving connection may be employed, if desired, but this is not essential.

Figure 6:
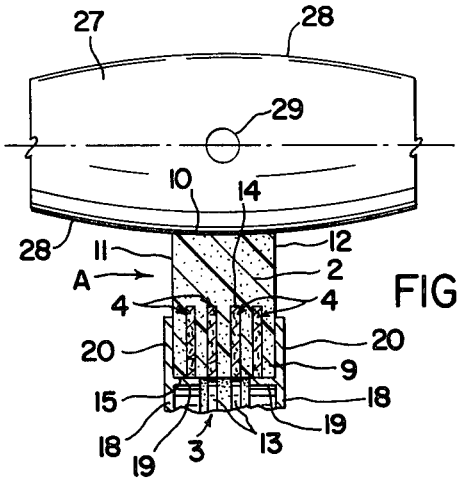
FIG. 6 is a fragmentary view in section showing the wheel in engagement with a workpiece.

An example of a finishing operation which can be performed by the wheel A is illustrated in FIG. 6. As shown therein, the polishing wheel A is in contact with a rotating steel workpiece 27 having a circular cross section with a diameter which gradually decreases in a direction outwardly from the center and having an exterior surface of revolution 28 which is curved in the longitudinal direction. The outer surface 10 of the polishing wheel A deforms when pressed against said surface 28 and is caused to conform substantially to the shape of the workpiece so that the wheel A does not form a flat spot on the piece. The polishing or finishing operation may be performed at a wheel speed from 5000 to 9000 surface feet per minute while rotating the workpiece 27 about its axis and while causing relative axial movement between the wheel and the workpiece.

If the workpiece has a hole in it, such as the circular hole 29 shown in FIG. 6, the soft deformable polyurethane tends to conform to the depression at such hole with the result that the wheel effects deburring and rounds off the marginal edge of the hole. This is true for cylindrical shafts as well as non-cylindrical parts. The finishing wheel of this invention is thus excellent for deburring at the same time that it provides the desired fine surface finish on the external cylindrical surface of the workpiece.

Figure 7:
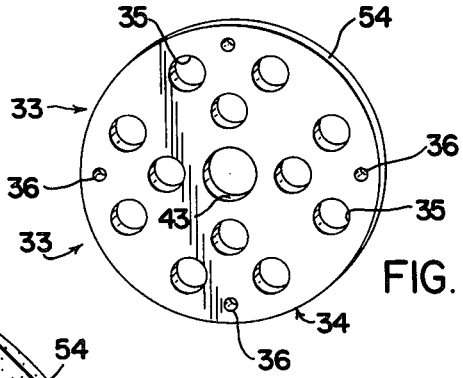
FIG. 7 is a perspective view on a reduced scale showing a modified form of reinforcing member used in the polishing and finishing wheel of FIGS. 8 and 9.
Figure 8:
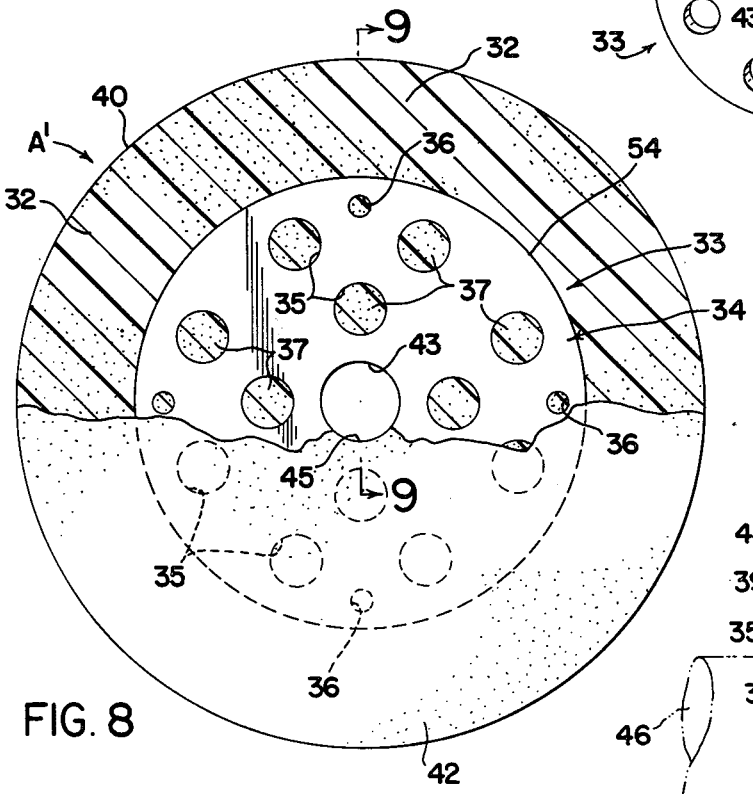
FIG. 8 is an elevational view showing a modified form of polishing and finishing wheel according to the present invention with parts broken away and shown in section.
Figure 9:
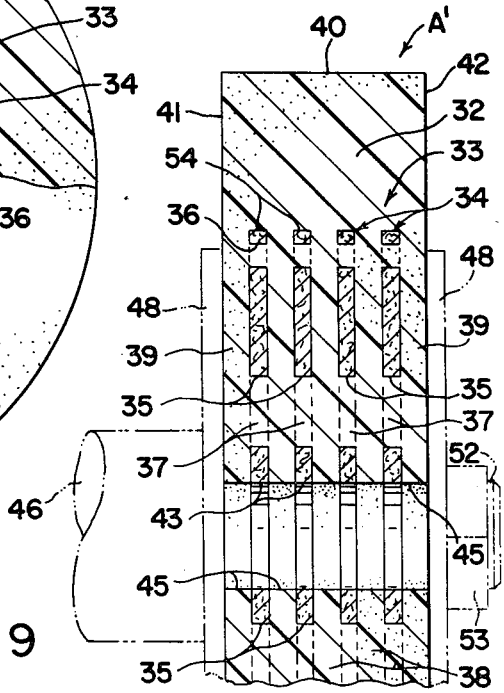
FIG. 9 is a fragmentary sectional view taken on the line 9—9 of FIG. 8 showing in broken lines how the wheel may be mounted.

FIGS. 7 to 9 illustrate a modified form of polishing wheel A' which functions like the wheel A but has a modified reinforcing means 33 best suited for wheels of smaller diameters (i.e., diameters of 2 to 8 inches). The sequence of numerals identifying the parts of wheel A' is such as to facilitate comparison of parts of that wheel with equivalent parts of wheel A.

The polishing and finishing wheel A' has an annular matrix 32 similar to matrix 2 and a series of flat circular reinforcing discs 34 arranged in regularly spaced parallel positions. Each disc has a large number of circular holes 35 and may also have small holes 36. After molding and curing, the matrix 32 has portions 37 extending through and filling the holes 35, portions 38 between the discs, and portions 39 at the side faces 41 and 42 of the matrix. The interior cylindrical surface 45 of the matrix 32 is concentric to the outer cylindrical work-engaging surface 40 and has the same diameter as the central circular holes 43 of the discs 34 so that it may be mounted on a shaft or arbor. As shown in dot-dash lines in FIG. 9, the wheel A' is mounted on the reduced end portion 52 of a shaft 46 between a pair of flat rigid circular metal discs 48 and rigidly clamped in position by a nut 53 on the threaded end of portion 52.

The embodiment of FIGS. 8 and 9 provides excellent reinforcement for the wheel and securely anchors the radially inner portion of the deformable matrix 32, but the embodiment of FIGS. 1 to 5 is preferred for wheels with a diameter greater than six inches because of the savings of material and the ease of molding.

In the embodiment of FIGS. 1 to 4, the wheel A may have an external diameter of 12 inches and an axial width of 1 inch and these dimensions can, of course, be varied. In this type of wheel the outside diameter of each reinforcing member 4 is usually about 1.5 to about 4 inches less than the outside diameter of the wheel and the inside diameter of the member 4 can, for example, be from 2 to 8 inches less than its outside diameter so that the radial width of member 4 is 1 inch or so for a moderate size wheel or up to 4 inches or so for a large wheel with a diameter of several feet.

The outer portion of matrix 2 radially outwardly of the reinforcing members 4 is free to deform and take the contour of the workpiece, but has a high density and high strength to resist deformation under centrifugal force. It is unreinforced and of uniform composition so that any and all parts thereof are essentially the same and consist essentially of a dense solid polyurethane containing a filler and abrasive refractory grains. Such outer portion usually extends radially about ¾ inch to about 2 inches, the maximum depending on the durometer hardness of the matrix and the speed at which the wheel is to be operated. Such outer portion extends radially no more than 2.5 inches from the reinforcing members 4 even in the larger wheels.

The wheels A of the present invention are unique in that they are made of a flexible solid polyurethane which was not previously used or considered suitable for polishing and finishing wheels. The polyurethane may, for example, be a polyester or polyether polyurethane formed by reacting a linear hydroxy-terminated polyester or polyether having at least 2 terminal hydroxyl groups and a molecular weight of at least 500 with an organic polyisocyanate having 2 to 3 functional isocyanato groups. The polyurethane may be of the general type disclosed, for example, in Hartz et al. U.S. Pat. No. 3,142,081.

The solid polyurethane can, for example, by made by mixing about 0.9 to 1.5 equivalent weights of an organic polyisocyanate, such as toluene diisocyante (TDI) or 4,4'-diphenylmethane diisocyanate (MDI), with one equivalent weight of a polyol having a molecular weight of 400 to 4000 (preferably 500 to 2000), such as a dihydroxy-terminated polyester, a polyalkylene ether glycol or the like. This may be cured by using a suitable curing agent. The polyisocyanate is preferably an aromatic diisocyanate such as TDI or MDI.

The solid polyurethane may be made from various polyester and polyether polyols such as polyalkylene adipates and other hydroxy-terminated polyesters or polyalkylene ether glycols, such as polyethylene glycols, polypropylene glycols or the like, as disclosed in said U.S. Pat. No. 3,142,081. In carrying out the invention it is preferred to employ polyurethane prepolymers of high viscosity.

When the solid polyurethane is a polyether, the polyether polyol used to form the polyurethane may, for example, be a conventional propylene oxide adduct of glycerol or other polyol treated to provide 3 primary hydroxyl radicals and a molecular weight preferably from about 1000 to about 3000. Many other polyether polyols having 2 to 4 hydroxyl groups are also suitable.

For example, a polyether urethane prepolymer may be prepared in known manner from MDI and a hydroxy-terminated polyether with a molecular weight of 400 to 3000, such as a polypropylene glycol or other conventional polyether polyol. The polyol should be essentially free of water. The prepolymer may, for example, have a NCO/OH ratio of 2.0 or greater and may have a solids content of approximately 100 percent.

The materials and procedure used to form the polyurethane prepolymers or other polymers used in the practice of the present invention are conventional and are disclosed, for example, in the books "The Development and Use of Polyurethane Products" by E. N. Doyle, Copyright 1971 by McGraw-Hill Book Company and "Polyurethane Technology" by Paul F. Bruins, Copyright 1969 by John Wiley & Sons, Inc. These books disclose diisocyanates and hydroxy-terminated polyesters and polyethers suitable for use in the practice of this invention.

Excellent results can be obtained using conventional polyester-based, isocyanate-terminated prepolymers having a viscosity of 1500 to 6000 centipoises at 212° F., such as WITCO FORMREZ P-211, P-314 or L10-72 made by Witco Chemical Corporation of Chicago, Illinois, or Uniroyal V-6007, V-6010 or V-6012 made by Uniroyal Corporation, Naugatuck, Connecticut, or A-95 made by American Cyanamid of Bound Crook, New Jersey.

While it is known how to produce high-viscosity polyurethane prepolymers which would be suitable for use in the polishing and finishing wheels of this invention, such prepolymers are not widely used in the grinding wheel art. The finishing wheel disclosed herein is unusual in requiring such high-viscosity prepolymers, in requiring a fast cure with high tensile strength and other physical properties, and in also requiring a wheel with a low durometer hardness. It is important to select the proper prepolymer and also the proper curing agent to meet these many different requirements.

The abrasive grains used in the practice of this invention are available commercially in standard sizes such as 60, 80, 100 up to 500 grit, and each finishing wheel preferably employs only one of these sizes.

The abrasives suitable for use in the finishing wheel are the common abrasives, such as silicon carbide and aluminum oxide, and various other abrasives, such as diamonds, boron carbide, cubic boric nitrite, emery, garnet and the like. Corundum and many other forms of aluminum oxide are suitable, and friability is usually not important.

In the polishing and finishing wheels of the present invention, the abrasive grains are used in a minor amount by weight with respect to the amount of polyurethane, and they preferably have a particle size of 60 grit and smaller (usually 80 to 320 grit) to effect the desired surface refinement without causing substantial stock removal. The stock removal is less than 0.0004 inch and may be only 0.0001 to 0.0002 inch or less depending on the hardness of the material being finished. In some special wheels made according to the invention, such as deburring wheels, the abrasive may have a larger particle size, such as 46 to 54 grit.

A typical polishing and finishing wheel made according xo the present invention has a matrix formed of a solid linear polyester or polyether urethane and containing a minor amount, such as from about 40 to about 90, and preferably at least 50 parts, by weight of abrasive refractory grains as described above.

The usual polyurethane composition used to form the matrix comprises 100 parts by weight of the polyester or polyether urethane (preferably a prepolymer having a viscosity at 212° F. from 1500 to 6000 centipoises), a small amount of a curing agent such as 1 to 6 parts by weight), up to 20 parts by weight of filler, which preferably includes both mica and molybdenum disulfide, and up to 90 or 100 parts by weight of the abrasive refractory grains. The composition should contain 3 to 10 or more parts by weight of mica per 100 parts of the polyurethane and could contain up to 20 parts of mica.

The composition should also contain ½ to 10 parts (preferably no more than 8 parts) by weight of molybdenum disulfide per 100 parts of polyurethane. The latter is very important to prevent clogging and buildup on the work-engaging surface of the wheel and makes it possible to do jobs which could not be performed otherwise. Graphite or carbon black or calcium carbonate could be used instead of molybdenum disulfide.

It is essential that the polyurethane composition has a high viscosity at the curing temperature and cures very fast so that the abrasive grains will remain evenly distributed until the degree of curing of the composition is sufficient to hold them in place. The curing agent should be selected to effect such degree of curing within a few minutes and preferably in 1 to 2 minutes.

In addition, the curing agent and the urethane polymer must be selected to provide the matrix with the necessary durometer hardness and with good physical characteristics including a tensile strength of at least 4000 pounds per square inch and an elongation of several hundred percent (i.e., 300 to 500 percent or more). The vast majority of the commercially available polyurethanes and curing agents are unable to meet these requirements. For example, reduction of the durometer hardness of the polyurethane is usually accompanied by loss of tensile strength and other properties. However, by meticulous choice of a polyurethane prepolymer and a curing agent, all of the above requirements can be met using conventional materials as will become apparent to those skilled in the art having the benefit of this disclosure.

Various polyurethane prepolymers are available commercially which are suitable, and various aromatic amines and other curing agents are also available. For example, the prepolymer may be WITCO FORMREZ L10-72, P-211 or P-314, as previously mentioned. Other suitable prepolymers are ISANOL 93 made by the Upjohn Company of Kalamazoo, Michigan, or butane diol made by the General Analine Company of New York, New York. The curing agent may be triisopropanol amine; nitroethanol amine, $N(CH_2CH_2OH)_3$; or various other fast-curing aromatic amines.

"FORMREZ P-211" is a polyester-based, isocyanate-terminated prepolymer having a viscosity at 140° F. of 28,200 centipoises and a viscosity at 212° F. of 4,200 centipoises.

"FORMREZ P-314" is another polyester-based, isocyanate-terminated prepolymer having a viscosity at 140° F. of 13,750 centipoises and a viscosity at 212° F. of 2,270 centipoises. This prepolymer and the P-211 prepolymer produce elastomers with high tensile strength and excellent physical properties.

"FORMREZ L10-72" is another polyester-based urethane prepolymer with a viscosity at 212° F. in the neighborhood of 2000 centipoises. It also produces elastomers with excellent physical properties. Such elastomers tend to have a durometer somewhat higher than those made from P-211 or P-314.

The polyurethane prepolymer used in the practice of this invention is one which can be cured to provide the desired physical properties preferably in a period of 1 to 5 hours at a temperature of 200° to 350° F. and which will provide the cured solid elastomer with a no-grain Shore A durometer hardness of 30 to 55. The elongation of the cured elastomer should be at least two hundred percent. The tensile strength should be at least 4000 pounds per square inch and the density should be high and preferably at least 100 pounds per cubic foot. Suitable procedures for making the finishing wheels are given in the examples below.

Because the abrasive grains tend to interfere with the lardness measurement, it is best to evaluate abrasive-containing elastomer in terms of the hardness of an identical elastomer without the abrasive grains. In other words, the material of the matrix 2 has a "no-grain" durometer hardness which is the hardness of the same elastomer, made and cured in the same way but without the abrasive. For example, where the "no-grain" Shore A durometer hardness is around 45 to 50, the actual Shore A durometer hardness would perhaps be 55 due to the hardening effect of the abrasive.

EXAMPLE I

A suitable composition for making the polishing and finishing wheel A of FIGS. 1 to 4 can be prepared using the following recipe:

1600 grams WITCO FORMREZ P-211 prepolymer
28.8 grams nitroethanol amine (liquid)
1280 grams silicon carbide (80 grit)
100 grams mica (325 grit)
10 grams molybdenum disulfide All of these materials, except the amine, are preheated above 200° F. (i.e., to about 212° F.) and thereafter rapidly mixed with the amine curing agent to provide a fast-curing polyurethane composition with the abrasive grains evenly distributed therein. This composition is quickly poured into a mold heated to 225° F. and containing the reinforcing members 4 held in axially spaced positions in the mold cavity. The material is caused to flow between said members and to fill the mold cavity, and the material is cured for 3 hours at 225° F. to develop full strength. A pressure of several hundred pounds per square inch is applied during curing. This is a compression molding operation.

Less than 3 minutes are required to complete the mixing and to effect the initial cure to a degree sufficient to hold the abrasive grains in place. Such initial cure takes place within about 2 minutes after mixing and before the abrasive grains have time to settle or to upset the uniformity of the wheel.

The resulting matrix 4 produced in this example can have a tensile strength well over 4000 psi and an elongation over 400 percent and a no-grain Shore A durometer hardness of about 45 to 50.

In the above example, the material can be cured in about 90 minutes at a temperature of 300° F., but the longer cure at a lower temperature is preferred.

EXAMPLE II

An excellent polishing and finishing wheel of comparable durometer hardness is made using substantially the same procedure as in Example I and using the following recipe:

1600 grams WITCO FORMREZ P-314 prepolymer
68 grams triisopropanol amine
1400 grams silicon carbide (80 grit)
60 grams mica (325 grit)
48 grams molybdenum disulfide In this example, a higher curing temperature is required and the mold is preheated to 300° F. The material is cured for 4 hours at 300° F. to develop full strength.

EXAMPLE III

An excellent polishing and finishing wheel of somewhat greater hardness can be made using the same recipe and the same procedure as in Example II by replacing the P-314 prepolymer with WITCO FORMREZ L10-72 prepolymer.

In the above examples, the compositions containing the P-314 and L10-72 prepolymers are cured for 4 hours at 300° F. If the curing temperature is lowered to 250° F., the curing time should be increased to about 6 to 8 hours.

The procedures of these three examples are suitable for making polishing and finishing wheels of many different sizes including those with an external diameter of 3 feet or more and an axial width of 6 inches. In the illustration of FIGS. 1 to 4, for example, the wheel A may have an outside diameter of 12 inches, an inside diameter of 7¼ inches, and an axial width of 1 inch, and the reinforcing members 4 may have an outside diameter of 9 inches and a thickness of ⅛ inch. The number of these reinforcing members may be either 3 or 4 in this particular wheel.

Finishing wheels made generally by the type of process described in the first of the above three examples have been found to provide exceptional results. It has been reported that, on some jobs which formerly used spirally-wound flexible wheels such as the "Tycro" wheel described previously, the total number of pieces which could be handled by such wheels was no more than 200, whereas a polyurethane finishing wheel made according to the present invention was able to perform the same operation on more than 1000 pieces without wearing out.

Because of the extreme long life of the wheel, the present invention opens up many new manufacturing processes. For example, it makes it commercially practical for the first time to use a finishing wheel of this type in a machine with a substantial setup time, such as a centerless machine used for polishing, lapping or honing, an O.D. grinder, or a special machine used for polishing ball bearings. The invention also makes it practical to perform a final finishing operation in one step in the manufacture of many pieces which formerly required at least two steps to achieve the desired surface finish. Another advantage of the wheel of this invention is that it can be contoured or cut by a diamond tool to the desired shape in much less time (for example, less than half the time required for a hard wheel). The soft dense flexible wheel of this invention lasts as long as a hard wheel and avoids gouging. Also, it is safer because it does not tend to pull out or catch on the piece. It is better because it tends to go around obstacles and into depressions. For example, the wheel is excellent for polishing or blending edges and for various delicate operations. Because of the uniformity of the wheel, it is much more reliable than setup wheels and other wheels previously used for that purpose.

Using a polishing wheel made according to the present invention and applying the wheel to the surface of a rotating workpiece having a surface roughness, for example, from 30 to 50 microinches, rms, it is possible in a single operation to reduce the surface roughness to 15 microinches or less. This is, of course, without a significant removal of material or a significant change in the dimensions of the workpiece. For example, the reduction in dimensions might be 0.0002 inch or less.

Using a finer abrasive grain, a finishing wheel made according to the present invention, when applied to a ground surface of a rotating workpiece having a surface roughness from 10 to 20 microinches, rms, can reduce the surface roughness in a single finishing operation to 5 microinches or less.

Using still finer abrasive grains, it is possible to perform lapping and honing operations which reduce the surface roughness to less than 2 microinches, rms. In these finishing operations the speed of the grinding wheel is preferably 5000 to 9000 surface feet per minute and the workpiece is usually rotated at a substantial velocity, which may sometimes be about half the angular velocity of the grinding wheel. The amount of material removed when using the finishing wheel of this invention is less than 0.0004 inch and may be less than 0.0001 inch.

The wheels of this invention are suitable for finishing workpieces formed of steel and many other metals and having many different sizes and shapes. They are particularly well-suited for use in automatic or semi-automatic grinding machines wherein the workpiece is supported and rotated about a fixed axis at a suitable speed, such as 20 to 50 revolutions per minute or more, while in contact with the grinding or finishing wheel, and means are provided for automatically causing relative axial movement between the revolving workpiece and the revolving abrasive wheel during the grinding or finishing operations. In centerless grinding, the abrasive wheel is held against axial movement, and the workpiece is moved axially by the regulating wheel which rotates at a moderate speed, such as one-tenth of the grinding speed. In a typical O.D. grinder, the workpiece is held against axial movement and the grinding wheel is moved axially.

Figure 10:
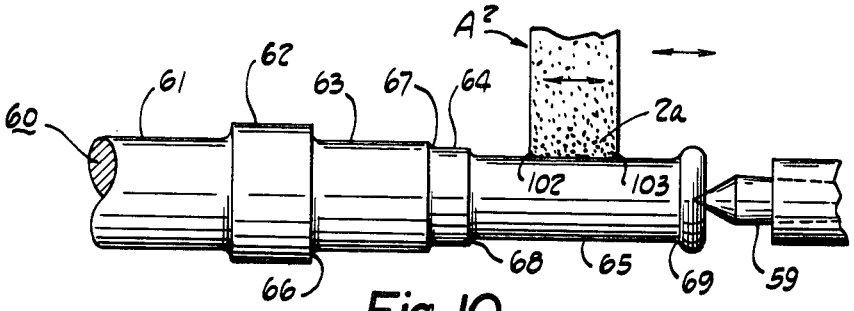
FIG. 10 is a fragmentary schematic view of an O.D. grinder using a polishing wheel made in accordance wih the present invention.

FIG. 10 of the drawings illustrates the use of a solid flexible polyurethane finishing wheel in a conventional O.D. grinder or cylindrical grinding machine in which the workpiece 60 is supported by centers 59 or other suitable holding means for rotation about a fixed axis and is slowly rotated as the rotating finishing wheel $A^2$ is moved axially relative to the work to effect grinding of the cylindrical surfaces 61, 62, 63, 64 and 65 of the workpiece.

Because said cylindrical surfaces have different diameters in the particular workpiece 60 shown in FIG. 10, the grinding wheel $A^2$ must be adjusted radially toward or away from the axis of the workpiece. The polyurethane wheel $A^2$ may be identical to the wheel A of FIGS. 1 to 5 and may have an elastomeric matrix 2*a* which is the same as the matrix 2 of wheel A, but it has sharply rounded edges 102 and 103 at the work-engaging surface of the wheel for finishing the rounded shoulders or fillets 66, 67, 68 and 69.

The edges 102 and 103 may have a small radius of curvature such as 0.1 inch or less and will hold the sharp edge for a relatively long period of time. This is possible because of the strong dense structure of the polyurethane, and it is important to provide a dense or non-cellular structure with no more than a few percent by volume of void spaces.

Figure 11:
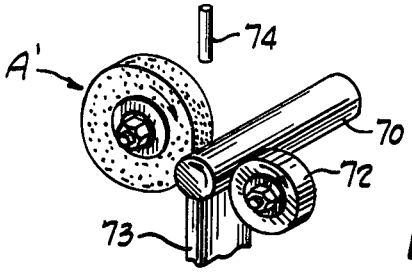
FIG. 11 is a fragmentary schematic perspective view on a reduced scale showing a centerless grinder employing a polishing wheel made in accordance with this invention.
Figure 12:
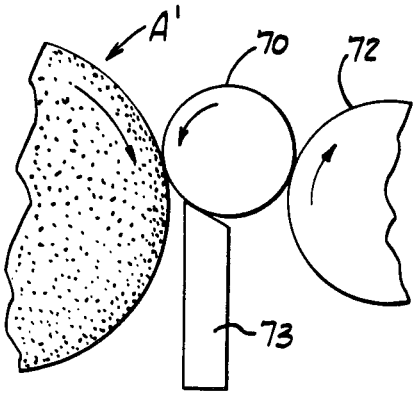
FIG. 12 is a fragmentary schematic side view of the grinder of FIG. 11.
Figure 13:
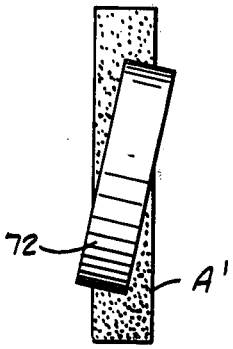
FIG. 13 is an end view of the grinder of FIG. 12.

FIGS. 11 to 13 illustrate the use of the polyurethane finishing wheel of this invention in a conventional centerless grinder, the basic elements of which are the abrasive wheel A', the regulating wheel 72, and the work-rest blade 73 which engages the lower surface of the revolving workpiece 70 during the grinding and finishing operations. A suitable grinding fluid is directed against the abrasive wheel and the workpiece by a supply nozzle 74. The regulating wheel 72 can be inclined a few degrees relative to the grinding wheel as shown in FIG. 12 to cause axial feeding of the workpiece past the grinding wheel.

The finishing wheel A' of FIGS. 11 to 13 can be identical to the wheel A' of FIGS. 8 and 9 or can be replaced by a finishing wheel of the type shown in FIGS. 1 to 5 or polishing wheels of various sizes up to several feet in diameter and can have axial widths from 1 inch to 6 inches or more. For example, flexible polyurethane finishing wheels made according to this invention with diameters from 10 to 36 inches and axial widths from 3 to 6 inches or more are well-suited for use in conventional centerless grinding machines.

Figure 14:
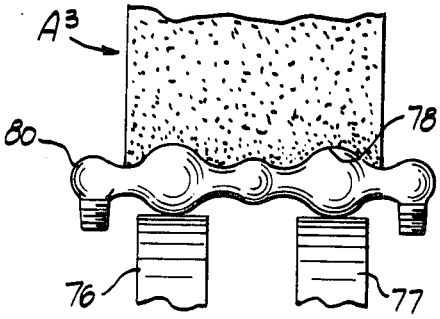
FIG. 14 is a fragmentary schematic elevational view of a modified form of centerless grinder using a profiled polyurethane polishing wheel.

Because the wheels of this invention are strong, dense and able to maintain a shape, they are well-suited for profile finishing operations as illustrated in FIG. 14 wherein a metal faucet 80 having two large globes in contact with a pair of regulating wheels 76 and 77 is polished by a flexible polyurethane finishing wheel $A^3$ having a contoured outer surface 78.

It will be understood that the present invention is concerned with "solid" elastomers which are essentially non-cellular and seldom contain more than 2 or 3 percent by volume of void spaces so that the density and tensile strength are relatively high. The finishing wheels made according to the invention have a surprisingly long useful life because of their ability to operate effectively without clogging or overheating and without rapid deterioration.

The term "grinding" as used herein and as understood in the art refers to a process wherein the abrasive grains cut and remove substantial amounts of material from the workpiece to reduce the dimensions a substantial amount, usually 0.001 inch or more. Such term excludes finishing wheels.

The term "finishing" as applied to a finishing wheel and as used herein and understood in the art refers to a process herein the surface of the workpiece is refined without significant metal removal to provide a desired surface roughness (for example, below 20 microinches, rms) without significant dimensional change (for example, a stock removal of less than 0.0004 inch) or wherein deburring is effected without significant dimensional change. Such term excludes grinding wheels but covers deburring wheels which do not effect grinding.

It will be understood that, in accordance with the provisions of the patent laws, variations and modifications of the specific articles and processes disclosed herein may be made without departing from the spirit of the invention.

Having described my invention, I claim:

1. A flexible reinforced polyurethane finishing wheel for a centerless grinder comprising a dense molded non-cellular annular matrix with a diameter of at least 10 inches and an axial width of at least one inch having a circumferential reinforcing means which resists radial expansion of said matrix, the radially outer portion of said matrix being deformable and being formed of a cured solid elastomeric polyurethane composition having a no-grain Shore A durometer hardness from about 30 to about 55, a density of at least 100 pounds per cubic foot, and a tensile strength of at least 4000 pounds per square inch and being capable of being elongated several hundred percent, said elastomeric composition comprising essentially a solid linear polyurethane which is the reaction product of a long-chain polyol having terminal hydroxyl groups and a molecular weight of at least 500 and an organic polyisocyanate having 2 to 3 functional isocyanate groups, said composition containing, per 100 parts by weight of said polyurethane, a minor amount no less than 50 parts by weight of finely divided abrasive refractory grains.

2. A flexible reinforced polyurethane finishing wheel for a centerless grinder comprising a flat flexible non-cellular annular matrix with a cylindrical work-engaging surface having a diameter of at least 10 inches and an axial width of at least one inch molded from a solid elastomeric composition and having a circumferential reinforcing means which resists radial expansion of said matrix, said reinforcing means terminating within two inches of the circumferential work-engaging surface of the wheel, said molded elastomeric composition having a no-grain Shore A durometer hardness from about 30 to about 55, a density of at least 100 pounds per cubic foot, and a tensile strength of at least 4000 pounds per square inch and being capable of being elongated several hundred percent, said elastomeric composition comprising essentially a solid linear polyurethane which is the reaction product of a long-chain polyol having terminal hydroxyl groups and a molecular weight of at least 500 and an organic polyisocyanate having 2 to 3 functional isocyanate groups, said composition containing, per 100 parts by weight of said polyurethane, a minor amount no less than 50 parts by weight of abrasive refractory grains having a practicle size from about 80 to about 320 grit.

3. A flexible polyurethane finishing wheel according to claim 2 in which said composition in the uncured state comprises a polyester or polyether urethane prepolymer having a viscosity at 212° F. of from 1500 to 6000 centipoises, from 0.4 to 10 parts of molybdenum disulfide per 100 parts by weight of said polyurethane, and a curing agent which cures and stiffens the polyurethane composition within 2 minutes after it is placed in the heated mold and before the abrasive grains can settle.

4. A process of making a finishing wheel comprising mixing 100 parts by weight of a polyester or polyether urethane prepolymer having a viscosity at 212° F. from about 1500 to about 6000 centipoises with from about 40 to about 90 parts by weight of abrasive refractory grains and a curing agent to provide a fast-curing polyurethane composition with the abrasive grains evenly distributed therein, causing the resulting composition to flow into a mold cavity containing a circumferential reinforcing member, and heating the mold to a temperature of at least 200° F. to cure and stiffen the polyurethane composition within two minutes after it is introduced into the mold cavity and before the abrasive grains can settle, and continuing the curing to provide a cured non-cellular polyurethane with a tensile strength of at least 4000 pounds per square inch capable of being elongated at least 300 percent, said curing agent being selected to provide such tensile strength and such fast curing and to provide a cured grinding wheel with a no-grain Shore A durometer hardness from about 30 to about 60 and a density of at least 100 pounds per cubic foot, a pressure in excess of one hundred pounds per square inch being applied during curing, said abrasive grains and said prepolymer being heated to a temperature of at least 200° F. before they are mixed together, said mold and said reinforcing member being heated to a temperature of at least 200° F. before the polyurethane composition is caused to enter the mold cavity.

5. A finishing wheel according to claim 1 wherein said composition contains from about 0.4 to about 10 parts of molybdenum disulfide per 100 parts by weight of said polyurethane.

6. A finishing wheel according to claim 1 wherein said composition in the uncured state comprises a polyester or polyether urethane prepolymer having a viscosity at 212° F. of from 1500 to 6000 centipoises.

* * * * *